United States Patent [19]

Plantureux et al.

[11] Patent Number: 4,731,913

[45] Date of Patent: Mar. 22, 1988

[54] PROCESS FOR MAKING JEWELRY COMPRISING ONE OR MORE ROWS OF STONES AND JEWELRY OBTAINED BY THESE PROCESSES

[75] Inventors: Alain M. Plantureux; Emile G. Magnien, both of Montpellier, France

[73] Assignee: Diamant Applications, Montpellier, France

[21] Appl. No.: 839,124

[22] Filed: Mar. 12, 1986

[30] Foreign Application Priority Data

Mar. 21, 1985 [FR] France ..... 85 04350

[51] Int. Cl.[4] ..... B23P 5/00

[52] U.S. Cl. ..... 29/40; 29/160.6; 63/28

[58] Field of Search ..... 29/10, 160.6; 63/26, 63/28; 81/7

[56] References Cited

U.S. PATENT DOCUMENTS

| | | | |
|---|---|---|---|
| 755,654 | 3/1904 | Guild | 63/28 |
| 795,109 | 7/1905 | Dover | 29/509 |
| 948,774 | 2/1910 | Strelitz | 63/28 |
| 1,308,011 | 6/1919 | Gilsey | 63/26 |
| 1,351,205 | 8/1920 | Eliasoff | 63/28 |
| 1,421,339 | 6/1922 | Zalowitz | 63/28 |

FOREIGN PATENT DOCUMENTS

| | | | |
|---|---|---|---|
| 0034977 | 9/1981 | European Pat. Off. . | |
| 208008 | 3/1909 | Fed. Rep. of Germany | 29/10 |
| 2386281 | 11/1978 | France . | |

*Primary Examiner*—P. W. Echols

*Attorney, Agent, or Firm*—Balogh, Osann, Kramer, Dvorak, Genova & Traub

[57] ABSTRACT

This invention relates to processes for making jewelry comprising one or more rows of precious stones set in a support made of precious metal. One or more rows of cylindrical housings extended by a conical seating and a counter-bore are machined in the support; the metal bridges separating, the housings are cut out with a rotating mill; a stone is placed in each housing and is set by means of a tool which is applied on the islets of metal remaining between the housings.

10 Claims, 11 Drawing Figures

Figure 1:
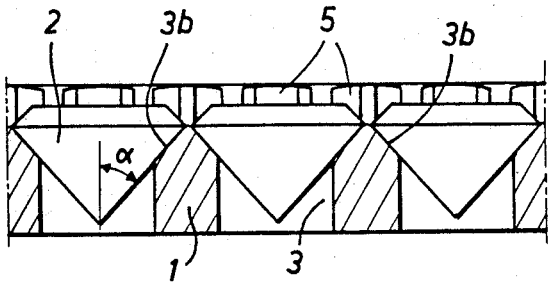

PROCESS FOR MAKING JEWELRY COMPRISING ONE OR MORE ROWS OF STONES AND JEWELRY OBTAINED BY THESE PROCESSES

The present invention relates to processes for making jewelry comprising one or more rows of stones, and to the jewelry obtained by these processes.

It is an object of the present invention to provide processes for making jewelry comprising a number of precious stones, and in particular brilliants, set on a support made of precious metal, in particular gold, to produce jewelry, for example rivieres of diamonds or diamond pavings comprising one or more rows of precious stones, very close to one another, with gaps between stones of the order of 0.05 mm, this rendering them very bright with a fine surface appearance.

The fixing of the precious stones on a gold support, particularly the fixing of small-sized, closely set diamonds, raises problems which are very delicate to solve.

The housings for the stones must be machined with very high precision both in their dimensions and in their respective positions and, taking into account the very high value of the precious stones, the means for fixing them must be very reliable. Moreover, the fixing means must not be too visible from the outside in order not to spoil the aesthetic appearance of the jewelry.

Numerical-control machine tools exist which enable supports of precious metal to be automatically machined with very high precision, of the order of 0.01 mm.

It is an object of the present invention to provide processes for automatically prefabricating in the factory supports made of precious metal, particularly gold, of various shapes, for example, rings, bracelets, pendants, etc . . . , so that such supports are ready to receive one or more rows of precious stones, disposed very close to one another, so that these stones are very easy to fix by setting and so that the fixing claws are hardly visible on the outside face.

At the present time, precious stones are, in the majority of cases, set on the jewelry.

French Pat. No. 1 506 317 to H. FAVRE describes a process whereby stones are set on a metal foil by means of a setting tool comprising a plurality of heads which penetrate in the metal, detaching a portion which they push against the stone in order to form a claw.

French Pat. No. 2 386 281 to BOWY describes a process wherein equidistant transverse grooves are cut in a gold support, then a bore is drilled between each pair of grooves, whose diameter is greater than the distance between grooves, this resulting in four projecting catches which are then bent over.

U.S. Pat. No. 2,749,597 to Walter FUS describes a process for manufacturing annular jewelry. The stones are set between two rings which each comprise an inner groove and the two rings are connected together by welded crosspieces.

French Pat. No. 80 04057 to DIAMANT APPLICATIONS describes processes for industrially manufacturing jewelry whereby the stones are placed in position by clipping each stone in a housing thanks to an elastic deformation of metal claws.

The objects of the invention are attained by means of a process for making jewelry comprising one or more rows of stones set in a support made of precious metal, said process comprising the following operations:

one or more rows of cylindrical housings extended by a conical seating and by a counter-bore, are machined in said support;

very thin metal bridges which separate the juxtaposed housings are cut out, with a rotating mill, over a height equal to that of said cylindrical housings, with the result that each housing remains surrounded by islets of metal, uniformly distributed over its periphery;

a stone is placed in each housing, said stone abutting on said conical seating;

and said stone is set by means of a hollow-headed tool, which is applied axially on said islets to deform them permanently by buckling.

According to a known embodiment, the diameter of each cylindrical housing is slightly smaller than the diameter of the circle circumscribed about the stone and there is cut out on the periphery of each cylindrical housing and above the seating, a peripheral groove of triangular section of which the diameter at the bottom of the groove is greater than the diameter of the cirlce circumscribed about said stones.

In this embodiment, a process according to the invention comprises the following operations of:

cutting out with a rotating mill the metal bridges separating the adjacent housings on the part located above the median plane passing through the bottom of said groove, with the result that there remain around each seating metal islets which constitute claws common to three seatings which each comprise a head and a curvilinear triangular foot, of reduced section, defined by three sections of groove which penetrate beneath said head, and the circle inscribed inside said heads has a diameter less than the outer diameter of said stone;

engaging in each housing surrounded by said claws a stone which pushes said claws outwardly by permanent deformation in flexion of the feet of said claws;

and, when the three stones surrounding a claw are in position, applying axially on the head of said claw a hollow-headed setting tool in order to deform by buckling the foot of said claw.

According to a preferred embodiment, if the stones are disposed in quincunx over several rows, said metal bridges are cut out with a mill rotating at high-speed about an axis which is placed successively above each of the points lying at the centre of the triangles formed by the centers of each group of three housings disposed in a triangle.

According to another preferred embodiment, if the stones are disposed in quincunx over several rows, the metal bridges are cut out with a mill rotating at high speed about an axis which is placed successively above the middle of each of the lines joining the two centers of two adjacent housings and said mill comprises a rounded inner cutting edge.

The invention makes it possible to obtain jewelry of the type comprising several rows of stones disposed in quincunx which are set in a support made of precious metal, by claws which have undergone a permanent deformation.

This jewelry is characterized in that each stone is surrounded by six claws and each claw is located at the centre of three stones and is common to these three stones.

Each claw presents, in that part located above the seating on which the stone rests, the form of a concave, curvilinear, triangular prism, of which the three side faces are constituted by three cylindrical sectors.

According to a preferred embodiment, each claw comprises a hemispherical head or a head in the form of a convex, curvilinear trihedron, which surmounts a foot of smaller section, having the form of a concave curvilinear triangle which is defined by three circular groove portions of triangular cross section which penetrate beneath said head.

The invention results in jewelry comprising a very dense paving of precious or semi-precious stones set in a support made of precious metal, for example rivieres of diamonds.

The jewelry according to the invention comprises stones preferably disposed in quincunx, each stone being set by six claws and each claw is located at the center of three stones disposed at the vertices of a triangle and it is common to these three stones.

This results in that each stone is set firmly by six claws whilst having a reduced total number of claws, hence a greater density of brilliants and an improved aesthetic appearance.

The processes for manufacturing jewelry according to the invention make it possible to prefabricate supports in the factory on numerical-control machine tools with the very high precision required both for the implantation of the housings for each stone and for the dimensions of these housings, such precision being of the order of a hundredth of a millimeter.

The curvilinear triangular form of the claws obtained by the process of machining facilitates the permanent deformation thereof by buckling and leads to a very reliable setting.

The process of setting by buckling the claws is particularly suitable for setting fragile stones, such as emeralds or semi-precious stones, as the mechanical efforts causing buckling are essentially applied on the claws without the stones being subjected to dangerous stresses.

The invention will be more readily understood on reading the following description with reference to the accompanying drawings, in which:

FIG. 1 is a tranverse section through a piece of jewelry according to the invention.

Figure 2:
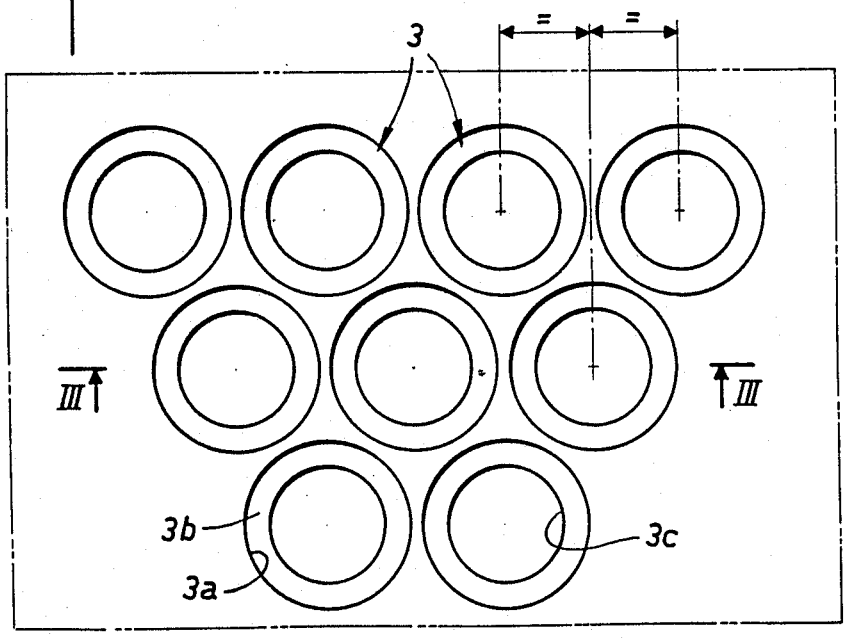
Figure 3:
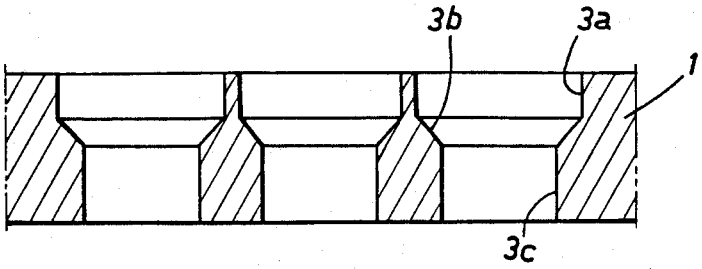

FIGS. 2 and 3 respectively show a plan view and a section along III—III of the first step of machining of the support.

Figure 4:
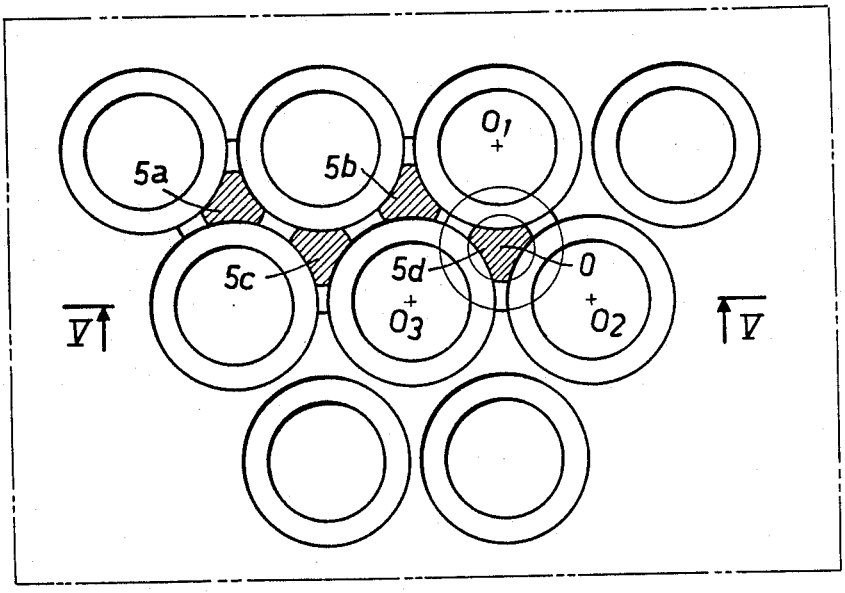
Figure 5:
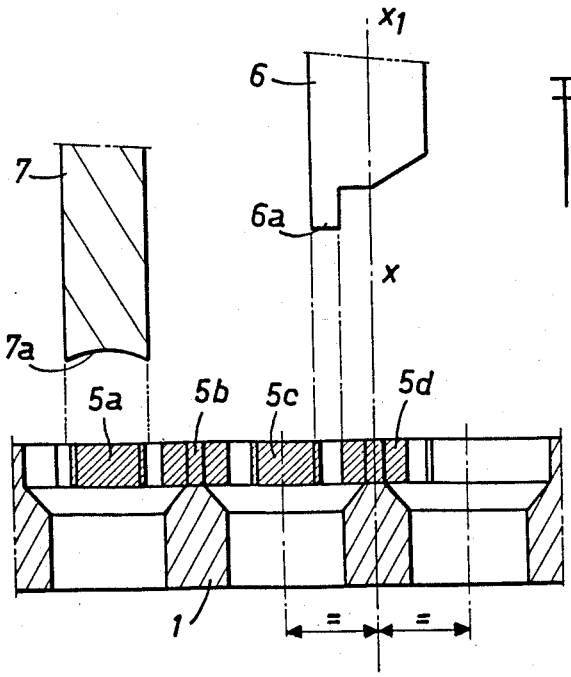

FIGS. 4 and 5 and respectively shows a plan view and a section along V—V of the support during the second phase of machining.

Figure 6:
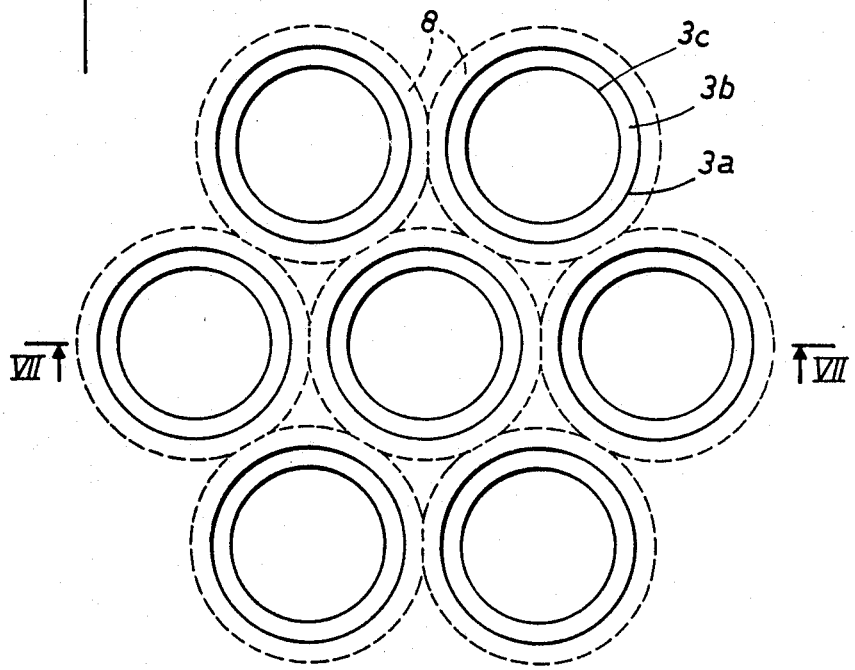
Figure 7:
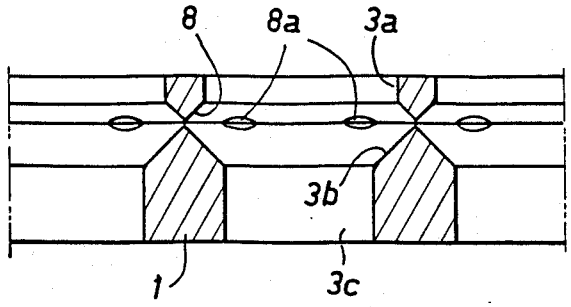

FIGS. 6 and 7 respectively show a plan view and a section along VII—VII of a second phase of the machining of the support in a variant embodiment.

Figure 8:
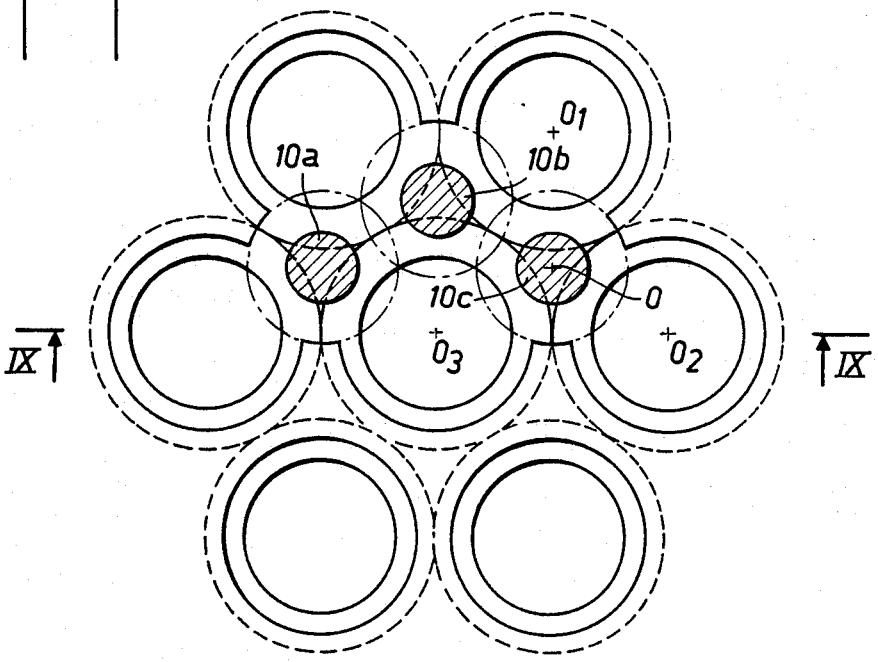
Figure 9:
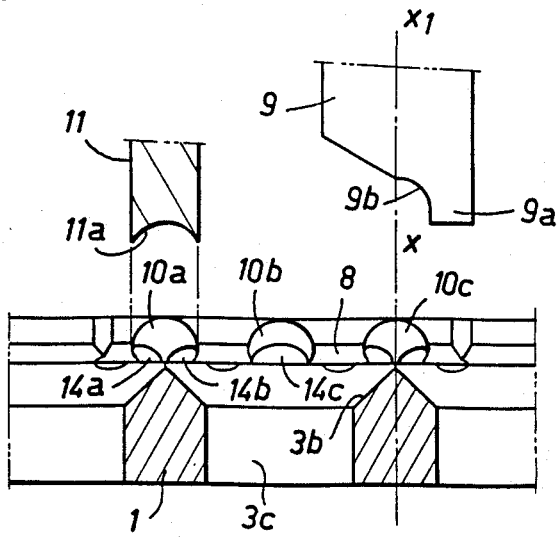

FIGS. 8 and 9 respectively show a plan view and a section along IX—IX of a third phase of machining of the support in the same variant embodiment.

Figure 10:
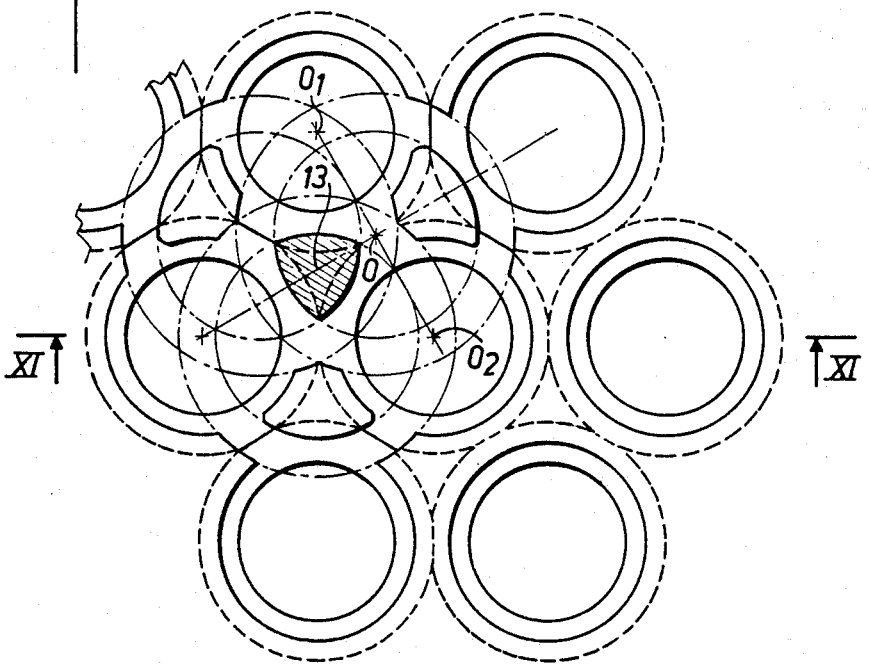
Figure 11:
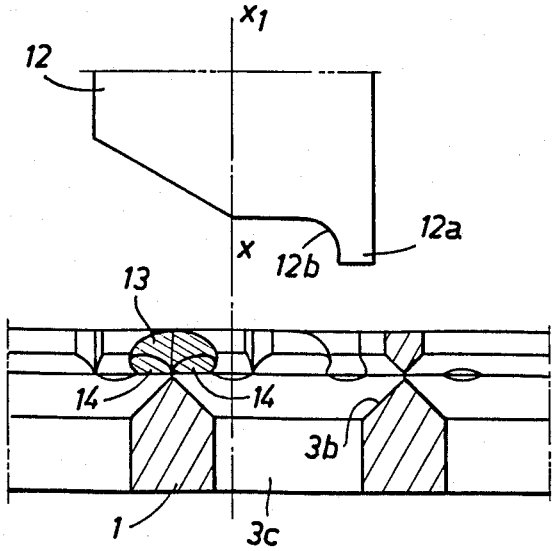

FIGS. 10 and 11 respectively show a plan view and a section along XI—XI of a third phase of machining of the support, in a variant.

Referring now to the drawings, a pair of jewelry according to the invention comprises a support 1 made of precious metal, preferably gold. This support may for example be a foil garnished with contiguous precious stones 2, general brilliants, and which may then serve to make jewelry such as rings, bracelets, pendants, brooches, etc..

The support 2 may also be constituted by the body of the jewelry itself, for example by a gold ring or bracelet or by a gold pendant or any other jewelry.

The jewelry according to the invention comprises one or more rows of contiguous stones 2, the gap between brilliants being of the order of 0.03 mm, with the result that the visible face is very bright.

The stones 2 used for making this jewelry are generally small-sized stones. These stones are calibrated by passage through screens whose meshes increase by 0.05 mm from one class to the following.

Series of screens may be used, having closer mesh dimensions, which define granulometric classes increasing by steps of 0.02 mm. In any case, the precision on the outer diameter of the stones, which constitutes the largest dimension, is therefore very high, the tolerance being 0.05 to 0.02 mm. Each piece of jewelry is composed of stones belonging to determined granulometric classes. Each stone 2 is set in a housing 3 which comprises a conical seating **3*b***, on which the stone abuts. The angle of opening of this conical seating corresponds substantially to the angle of the stones which is a determined angle.

The Figures show embodiments in which the stones are identical and are disposed in quincunx in parallel rows, the centers of the stones being equidistant.

It is specified that these examples are not limiting. The same jewelry may comprise rows of stones of different size. The stones may be disposed in curved lines, for example along arcs of a circle. The centers of the stones need not be equidistant.

The jewelry may comprise one or more rows of stones. If it comprises several rows, the stones are advantageously disposed in quincunx.

Each stone 2 is maintained in its housing by six claws 5 distributed regularly about its periphery.

FIGS. 2 to 5 show the successive steps of a first process for machining the support.

The support 1 which is to be garnished with stones, is placed on the work table of a numericalcontrol machine tool which displaces the table beneath a rotating mill or drill. This tool pierces through the support 2 rows of cylindrio-conical housings 3 which are equidistant and disposed in quincunx.

Each housing comprises an outer cylindrical bore **3*a* whose diameter is slightly greater than the upper limit of the class of granulometry chosen. For example, if diamonds having a diameter of between 1.10 mm and 1.15 mm are chosen, bores 3*a* are machined, having an outer diameter of 1.15 mm with a tolerance of +0.01 mm. The depth of the bores 3*a* is greater than the thickness of the head of the stones, so that, when the brilliants are placed on the conical seating 3*b*, their upper face lies below the upper face of the support 1, as shown in FIG. 1**.

Each housing also comprises a conical seating **3*b* of which the angle of opening corresponds to the angle of cut of the stones. Finally, each housing 3 comprises a cylindrical bore 3*c* which may open out on the rear face of the support, as shown in FIG. 2**.

In a variant, the bore **3*c* may be a blind bore. It suffices that the depth of bore 3*c*** be greater than the height of the stones.

The cylindro-conical housings 3 are disposed in quincunx and their respective positions are such that the bridges of metal which separate two adjacent housings are very thin webs having a thickness of the order of 0.05 mm.

By machining the housings 3 on a numerical-control machine tool, the very high precision necessary in the dimension of the bores and in the implantation thereof is obtained. The tool may also be oriented perpendicularly to the front surface of the support 1. The quincunx arrangement enables a greater density of brilliants per surface unit to be obtained.

FIGS. 4 and 5 respectively show a partial plan view and a section along V—V of the support 1 during the second machining phase.

The support 1 is still disposed on the work table of a numerical-control machine tool, on the tool-holder of which is mounted a tool 6 which rotates about an axis x–x1. This tool is for example a cylindrical bar made of tungsten carbide comprising a head 6*a* which is driven in rotation at very high speed. This head comprises two cutting edges parallel to the axis of rotation x–x1.

The work table is displaced to bring axis x–x1 successively above each of points O located at the center of each group of three housings 3 disposed in a triangle.

FIGS. 4 and 5 show the tool 6 positioned so that its axis x–x1 passes through point O located at the center of the triangle formed by the centres $O_1$, $O_2$ and $O_3$ of a group of three housings 3.

In the precise case of the Figure, points $O_1$, $O_2$ and $O_3$ are disposed at the vertices of an equilateral triangle of which point O is the center.

FIG. 4 shows the two concentric circles swept by the cutting head the cutting edges of the 6*a*. The height of head 6*a* is equal to the depth of the outer bores 3*a*, with the result that the tool 6 removes the the thinner part of three metal bridges intercalated between the three outer bores 3*a* centered at $O_1$, $O_2$ and $O_3$.

The outer diameter of head 6*a* is slightly greater than the distance separating the center O from the three sides of the equilateral triangle.

After removal of the intercalated bridges, there remains around each center O an islet of metal having the form of a curvilinear triangular prism of which the side faces are concave and are constituted by three cylindrical sectors belonging to the three adjacent bores 3*a*.

FIG. 4 shows an intermediate step. For greater clarity, the metal islets 5*a*, 5*b*, 5*c*, 5*d* are hatched in FIGS. 4 and 5.

Once the machining operations are terminated, a stone 2 is placed by hand in each housing so as to abut against the conical seating 3*b*. In this variant, the circule inscribed inside the six claws which surround a housing, has a diameter greater than the diameter of the stone which therfore penetrates freely in its housing. When the three stones surrounding an islet of metal 5 have been placed in position, a setting tool 7, shown in axial section in FIG. 5, is applied on this islet. This tool is in the form of a cylindrical punch terminating n a concave head 7*a* whose diameter is slightly greater than the diameter of the circle in which the islets 5 may be inscribed. Tool 7 is applied with a sufficient force to cause the islet 5 to undergo a permanent deformation by buckling, with the result that, when all the islets have been deformed, each stone is set by six triangular claws formed by the islets 5. Each claw is common to three juxtaposed stones disposed at the vertices of a triangle.

Each claw which is surrounded by three stones with a very small clearance, is deformed by buckling solely in the axial direction as it is maintained laterally by the three stones which surround it and which prevent any deformation in flexion.

FIGS. 6 to 9 shows the successive steps of machining of a support 1 in a variant of the process.

The first machining step is identical and is not shown. At the end of this first step, support 1 is pierced with a plurality of rows of housings 3 disposed in quincunx. Each housing 3 comprises an outer bore 3*a*, a conical seating 3*b* and a counterbore 3*c*, whose diameter is less than that of bore 3*a* and which may be a blind bore.

Contrary to the process according to FIGS. 2 to 5, the diameter of the outer bore 3*a* is slightly less than the diameter of the stones. For example, for stones having a diameter of between 1.75 mm and 1.80 mm, the bores 3*a* have a diameter of 1.65 mm.

FIGS. 6 and 7 respectively shows a partial plan view and a view in section along VII—VII after the second machining step. In the course of this step, an inner groove 8 is cut out on the periphery of each bore 3*a* and immediately above seating 3*b*, said groove having a triangular section which extends the slope of the conical seating 3*b*. The diameter at the bottom of the groove 18 is larger than the outer diameter of the stones. For example, for stones whose diameter is between 1.75 and 1.80 mm, the diameter at the bottom of the groove is at least 2 mm.

In this embodiment, the metal bridges separating two housings 3 before the grooves 8 are hollowed out, are thicker. For example, for housings 3 having a diameter of 1.65 mm, the distance between centres of two adjacent bore is 1.97 mm.

This distance is advantageously less than the outer diameter of grooves 8 so that the grooves of two adjacent housings intersect as shown in FIGS. 6 and 7. References 8*a* represent the intersections of groove 8 of the bore located in the plane of section with the grooves of the bores located to the rear of the plane of section.

The fact that the grooves intersect means that the transverse sections of the feet of the claws are sufficiently weak to bend laterally, to allow the stones to pass, then to buckle during setting.

The grooves 8 are machined on a numerical-control machine tool by means of a rotating mill which is positioned successively in the axis of each of bores 3*a*.

FIGS. 8 and 9 show another step of machining of a support 1 in the second embodiment. In the course of this step, the support 1 still being on the work table of the machine tool, a rotating mill 9 is mounted on the tool holder, which mill comprises a milling head 9*a* having an inner edge 9*b* of rounded shape, for example in the form of a quarter circle. The height of the milling head is preferably equal to or slightly greater than the distance separating the median plane of the groove 8 passing through the bottom of said groove from the outer face of the support, with the result that the mill 9 removes metal only above the bottom of the groove.

By displacing the work table, the support 1 is placed in successive positions where the axis x-xl of the tool passes through points O located at the centre of each triangle formed by the centers $O_1$, $O_2$ and $O_3$ of ecah group of three bores 3 disposed in a triangle.

FIG. 8 represents by the smaller broken-line circles the circular traces of the tool 9 which removes the metal bridges located between the bores and which leaves metal islets 10*a*, 10*b*, 10*c* which are hatched in order to render the drawing clearer.

Each metal islet which constitutes a claw comprises a hemispherical head 10*a*, 10*b*, 10*c* which has been cut out by the rounded edge 9*b*. This edge surmounts a foot of smaller section which has the form of a curvilinear triangle of which the three sides are concave and are defined by three circular groove sections 14*a*, 14*b*, 14*c*, of triangular cross section which penetrates beneath the hemispherical head.

The circle inscribed inside the six heads of claws which is the primitive circle 3a, has a diameter less than the outer diameter of the stone.

Once the machining operations are terminated, a stone 2 is engaged in each housing 3 surrounded by six claws. When the stone is being engaged, it pushes claws 10a, 10b, 10c, etc . . . outwardly of the housing 3.

The claws deform by flexion of the foot which is the weakest and such deformation is permanent.

When a stone is placed in an adjacent housing, said stone pushes the claws located between the two housings in opposite direction and said claws are deformed again by flexion of the foot. The groove 14 located on the side where the first stone has already been positioned, presents a clearance with respect to this stone and enables the claw to straighten up.

When the three stones surrounding a claw have been positioned, the concave end 11a of a setting tool 11 is then applied axially on the head of each claw 10a, 10b, 10c, . . .

This end 11a is preferably in the form of a hemisphere which follows the shape of the heads. Thrust of the tool 11 provokes axial buckling of the foot of each claw.

The grooves 14a, 14b, 14c which define a foot of reduced section, facilitate, on the one hand, the outward flexion of the claws when a stone is engaged and, on the other hand, the buckling of the foot. During the operation of setting by buckling, each claw is maintained laterally by the three stones which surround it, with the result that they cannot bend laterally and an axial buckling is obtained.

It will be noted that the process of setting by axial buckling is different from the processes of setting in which the claws are bent down ont the stones, as well as from the processes by clipping in which the stones are driven between the claws which deform elastically then resume their initial position under the action of the elastic return forces.

FIGS. 10 and 11 show a second variant of the embodiment of FIGS. 6 to 9.

The first steps of machining are identical to those of the preceding process, i.e., in a first step, rows of cylindro-conical housings 3, disposed in quincunx as shown in FIGS. 2 and 3, are hollowed out, then a groove 8 having a triangular profile as shown in FIGS. 6 and 7, is cut out on the periphery of these housings.

FIG. 10 shows a partial plan view and FIG. 11 a section along XI—XI during the operation of machining the metal bridges which separate the bores 3. This machining is effected by means of a rotating mill 12, of axis x-xl, which comprises a milling head 12a having an inner edge 12b of concave form.

The radius of tool 12 is greater than the radius of tool 9. By successive displacements of support 1, mounted on the work table of the machine tool, the axis x-xl of the tool is brought above each point O, equidistant from each pair of centres $O_1$, $O_2$ of two juxtaposed housings 3. Several successive paths of tool 12 have been shown in FIG. 10 by dashed circles.

After all the metal bridges have been removed, there remain between the housings 3 metal islets 13 which comprise on their top a dome formed by three convex surfaces which defines a curvilinear trihedron. At its base, each islet is defined by three grooves 14 which are portions of three grooves 8 disposed as a curvilinear triangle, which penetrate beneath the dome.

FIGS. 10 and 11 show an islet 13 which has been hatched to render the drawing clearer. As before, a stone is then engaged in each housing 3, applying it on the seating 3b then there is applied on each islet 13 a setting tool having a concave head in which the islet penetrates and it is pushed sufficiently to obtain permanent deformation by buckling of the feet of the islets defined by the grooves 14.

According to this variant embodiment, each stone is set by six claws 13, of curvilinear triangular form with convex faces which give the jewelry an original aesthetic appearance. Each claw 13 is common to three stones and is located at the center thereof.

FIGS. 4 and 5, 8 and 9, 10 and 11 show the machining of the bridges located between two rows of housings.

If there is only one row and if there are several rows as far as the border rows are concerned, the metal bridges which separate the claws are removed by means of the same rotating mill 6 or 9 which is positioned successively above points occupying, with respect to the centres of the stones, geometrical positions corresponding to the positions of points O shown in these Figures.

In the case shown in FIG. 1, the axis x–x1 of mill 12 may be positioned successively in line with the axis of each bore 3.

FIGS. 4 and show claws having the form of a curvilinear triangular prism of which the side faces are concave and constituted over the whole of their height by cylindrical sectors belonging to three adjacent bores 3a.

In order to improve the aesthetic effect, if is preferable to have claws with rounded head. To this end, the upper part of each claw is machined so as to have a downwardly tapering truncated form of which the base is inscribed inside the curvilinear triangular section of the triangular prism.

Such machining may be effected on a numerical-control machine by means of a rotating mill having an obliquie cutting edge which is successively positioned in the axis of ecah claw. It may also be made by circular interpolation with a rotating mill in the form of a truncated punch of which the axis of rotation describes a circle centred on the axis of each claw.

What is claimed is:

1. A process for making jewelry comprising one or more rows of stones set in a support made of precious metal, said process comprising the following steps:

machining said support to form one or more rows of cylindrical housings comprising an outer bore, a conical seating and a counter-bore the housing being separated by metal bridges of at least two thicknesses;

cutting, with a rotating mill the thinner part of the metal bridges which separate juxtaposed outer bores over a height equal to that of said outer bores with the result that each outer bore remains surrounded by islets of metal, uniformly distributed over its periphery;

placing a stone in each housing; said stone abutting on said conical seating;

and setting said stone by means of a concave-headed tool, which is applied axially on said islets to deform them permanently by buckling.

2. The process of claim 1 in which the diameter of each outer bore is slightly smaller than the outer diameter of the stone placed in said outer bore said process comprising the following steps of:

cutting out on the periphery of each outer bore and immediately above said seating a triangular groove having an outer diameter greater than the outer diameter of said stone;

cutting out with a rotating mill the thinner part of the metal bridges separating two adjacent outer bores on the part located above said groove with the result that there remain around each conical seating metal islets.

3. The process of claim 2, wherein the diameter of the bottom of said grooves is slightly larger than the distance separating the centers of two adjacent housings, with the result that said grooves do not intersect.

4. The process of claim 3, in which said stones are disposed in quincunx over several rows, comprising the following steps of cutting said metal bridges out with a mill rotating at high-speed about an axis which is placed successively above the center of each of the triangles formed by the lines joining the centers of three adjacent housings.

5. The process of claim 3, in which the stones are disposed in quincunx, comprising the following steps of cutting said metal bridges out with a mill rotating at high speed about an axis which is placed successively above the middle of each line joining the two centers of two adjacent housings and said mill comprises a rounded inner cutting edge.

6. The process of claim 2, in which said stones are disposed in quincunx over several rows, comprising the following steps of cutting said metal bridges out with a mill rotating a high-speed about an axis which is placed successively about the center of each of the triangles formed by the lines joining the centers of three adjacent housings.

7. The process of claim 2, in which the stones are disposed in quincunx, comprising the following steps of cutting said metal bridges out with a mill rotating at high speed about an axis which is placed successively above the middle of each line joining the two centers of two adjacent housings and said mill comprises a rounded inner cutting edge.

8. The process of claim 1 in which said stones are disposed in quincunx over several rows comprising the step of cutting out said metal bridges with a mill rotating at high-speed about an axis which is placed successively above the center of each of the triangles formed by the lines joining the centers of three adjacent housings.

9. The process of claim 8, wherein said mill comprises an inner cutting edge of rounded form.

10. The process of claim 1 in which the stones are disposed in quincunx, comprising the step of cutting out said metal bridges will a mill rotating at high speed about an axis which is placed successively above the middle of each line joining the two centers of two adjacent housings and said mill comprises a rounded inner cutting edge.

* * * * *